US011766804B2

(12) United States Patent
Hess et al.

(10) Patent No.: US 11,766,804 B2
(45) Date of Patent: Sep. 26, 2023

(54) COLLAPSIBLE CHAINSAW

(71) Applicants: Preston Hess, Berlin, WI (US); Nicholas Krause, Berlin, WI (US)

(72) Inventors: Preston Hess, Berlin, WI (US); Nicholas Krause, Berlin, WI (US)

( * ) Notice: Subject to any disclaimer, the term of this patent is extended or adjusted under 35 U.S.C. 154(b) by 127 days.

(21) Appl. No.: 17/065,114

(22) Filed: Oct. 7, 2020

(65) Prior Publication Data

US 2021/0101303 A1 Apr. 8, 2021

Related U.S. Application Data

(60) Provisional application No. 62/911,425, filed on Oct. 7, 2019.

(51) Int. Cl.
*B27B 17/08* (2006.01)
*B27B 17/00* (2006.01)

(52) U.S. Cl.
CPC ..... *B27B 17/08* (2013.01); *B27B 17/0008* (2013.01)

(58) Field of Classification Search
CPC ..... B27B 17/0008; B27B 17/08; B27B 17/00; B27B 17/02; B27B 17/083
USPC ..... 30/161, 381–387, 296.1
See application file for complete search history.

(56) References Cited

U.S. PATENT DOCUMENTS 727,724 A * 5/1903 Weil ..... B26B 1/04 30/161
1,341,153 A * 5/1920 Parker et al. ..... A47G 21/08 30/143
1,895,342 A * 1/1933 Pelton et al. ..... B26B 23/00 30/308.2
2,970,730 A * 2/1961 Schwarz ..... B28D 5/0011 438/464
3,343,613 A * 9/1967 Carnesecca, Jr. et al. ..... B27B 17/08 30/381
4,145,810 A * 3/1979 Belliston ..... A01G 3/053 30/296.1
4,184,395 A * 1/1980 Blachly et al. ..... B27B 5/201 83/486.1
4,207,675 A * 6/1980 Causey ..... B27B 17/0008 30/296.1
4,654,971 A * 4/1987 Fettes ..... B27B 17/08 30/296.1
4,760,646 A * 8/1988 Siegler ..... B27B 17/0008 30/382
4,916,818 A * 4/1990 Panek ..... B27B 17/0008 30/296.1
5,013,282 A * 5/1991 Keller ..... B27B 17/08 464/178
D353,751 S * 12/1994 Germano ..... D8/8
5,411,238 A * 5/1995 Caron ..... F16M 13/00 30/296.1

(Continued)

*Primary Examiner* — Jason Daniel Prone
(74) *Attorney, Agent, or Firm* — Joseph T. Leone; DeWitt LLP

(57) ABSTRACT

The present invention is a collapsible chainsaw. The chainsaw includes a protective housing to which a saw bar having a saw chain is rotatably mounted at one end via a notched positioning hub. The chainsaw has two configurations. These configurations are the open or cutting configuration, which positions the saw bar straight out from the housing or main body of the chainsaw, and a collapsed or closed configuration, which positions the saw bar parallel to the housing.

3 Claims, 10 Drawing Sheets

(56) References Cited

U.S. PATENT DOCUMENTS 5,647,129 A * 7/1997 Stamper ..... B26B 1/042 30/139
5,653,028 A * 8/1997 Hashimoto ..... B27B 17/12 30/384
5,685,080 A * 11/1997 Amano ..... B27B 17/08 30/383
5,884,403 A * 3/1999 Rogers ..... B27B 17/0008 30/296.1
5,915,792 A * 6/1999 Sakurai ..... B26B 1/048 30/155
6,112,419 A * 9/2000 Uhl ..... B27B 17/0008 30/381
6,397,452 B1 * 6/2002 Frosberg ..... B27B 17/025 30/387
6,488,511 B1 * 12/2002 Stewart ..... B27B 17/0008 30/296.1
6,651,347 B2 * 11/2003 Uhl ..... B27B 17/08 30/296.1
7,093,366 B2 * 8/2006 Black ..... A01G 3/053 30/296.1
7,752,760 B2 * 7/2010 Baskar ..... A01G 3/053 30/296.1
8,186,066 B2 * 5/2012 Doragrip ..... A01G 3/053 30/296.1
8,793,886 B2 * 8/2014 Yamaoka ..... A01G 3/053 30/296.1
8,836,529 B2 * 9/2014 Thomsen ..... B27G 19/003 30/381
9,032,630 B2 * 5/2015 Brown ..... B27B 17/08 30/383
9,314,916 B2 * 4/2016 Tsuchiya ..... A01G 3/053
9,539,717 B2 * 1/2017 Fuchs ..... B27B 17/02
9,815,220 B2 * 11/2017 Madson ..... B25G 1/04
10,130,043 B1 * 11/2018 McNamara ..... B27B 17/02
10,375,896 B2 * 8/2019 Sheffer ..... B25G 1/04
11,284,568 B2 * 3/2022 McCue ..... A01G 3/053
11,369,057 B2 * 6/2022 Palermo ..... A01D 34/416
11,383,400 B2 * 7/2022 Farneth ..... B27B 17/0083
2008/0277132 A1 * 11/2008 Pesik et al. ..... B25F 5/001 173/213
2012/0157257 A1 * 6/2012 Hirabayashi ..... B27B 17/08 192/93 R
2012/0165152 A1 * 6/2012 Tokunaga et al. ..... B25F 5/001 475/159
2014/0096399 A1 * 4/2014 Fuchs ..... B23D 57/023 30/151
2015/0273722 A1 * 10/2015 Madson ..... B27B 17/08 30/386
2015/0290830 A1 * 10/2015 Zieger ..... B27B 17/02 30/381
2022/0134592 A1 * 5/2022 Yamaoka ..... B27B 17/0083 30/166.3

* cited by examiner

COLLAPSIBLE CHAINSAW

CROSS-REFERENCE TO RELATED APPLICATIONS

This application claims the benefit of prior-filed, co-pending U.S. Provisional Patent Application No. 62/991,425, filed on Oct. 7, 2019, the contents of which are incorporated herein by reference in their entirety.

BACKGROUND

This invention relates to a chainsaw, specifically a chainsaw which may be collapsed for portability and ease of transport.

Hunters, campers, and other outdoorspersons may need to cut thick lengths of wood for a variety of uses. Full-sized chainsaws, while useful for such applications, are often too heavy and bulky to carry by backpackers or in vehicles with limited cargo space and/or weight. They may also be too large to easily control, and be too powerful for the limited applications an outdoorsperson put them to. Most chainsaws are also so large that they require gasoline fuel and cannot be powered by batteries, giving them limited utility in remote locations. This liquid fuel source also increases the hazards in storage and transportation of chainsaws.

There is an unmet need for a battery-powered chainsaw capable of being collapsed into a compact configuration.

BRIEF SUMMARY

The present invention is a collapsible chainsaw device. The device includes a motor mounted to a protective housing and a saw bar mounted to the protective housing by means of a positioning hub. The saw bar may rotate about an axis of the positioning hub from an open configuration where the saw bar extends distally from a distal end of the protective housing to a closed configuration where the saw bar extends proximally from the distal end of the protective housing. The device also includes a saw chain mounted to the periphery of the saw bar and connected to the motor by means of a planetary gear drive system which drives a chainsaw drive sprocket, whereby the motor drives the saw chain.

Figure 1A:
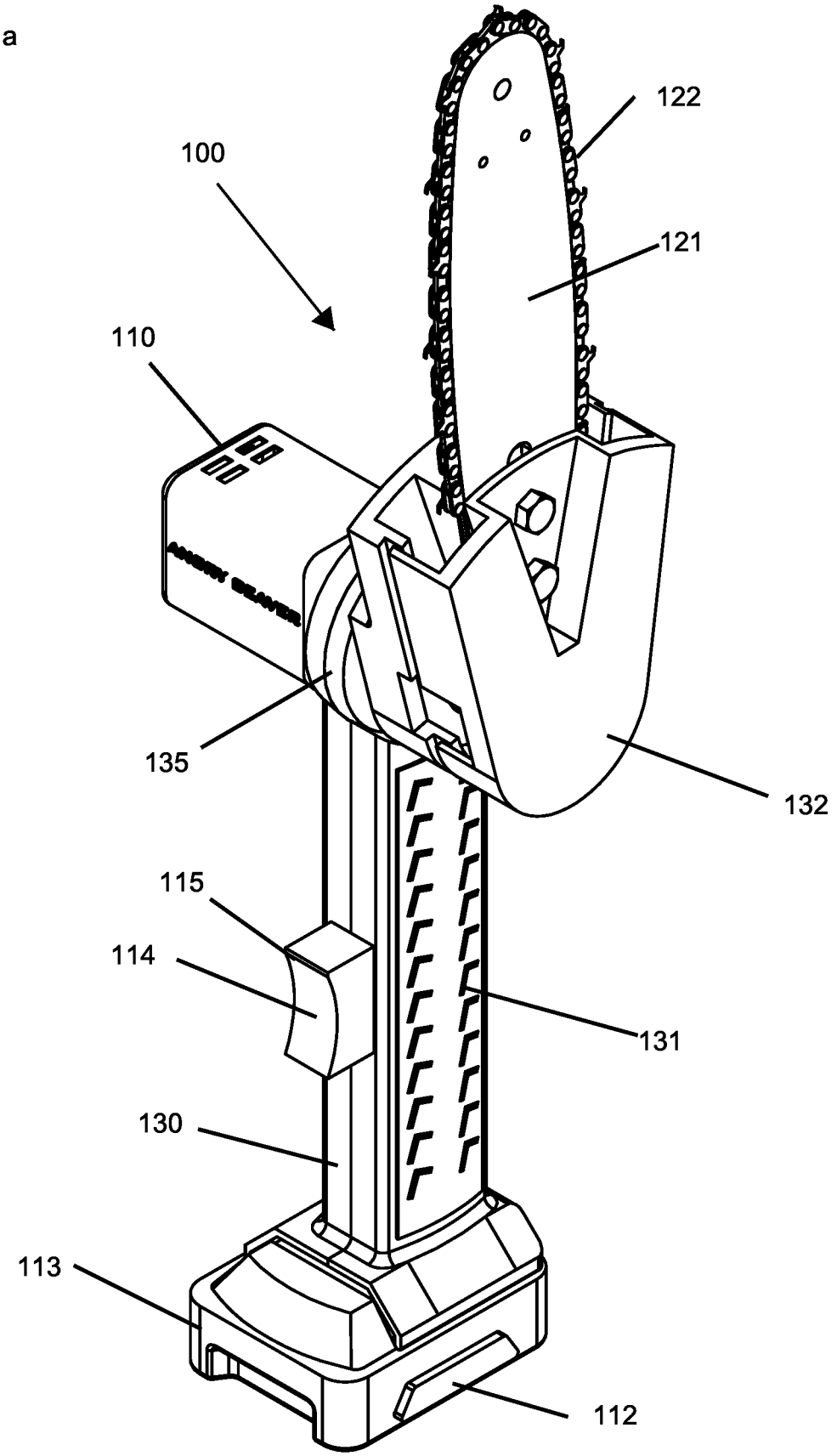
FIGS. 1*a*, 1*b*, 1*c*, and 1*d* illustrate front perspective, back, right side, and front views, respectively, of an exemplary embodiment of a collapsible chainsaw in an open position.
Figure 1B:
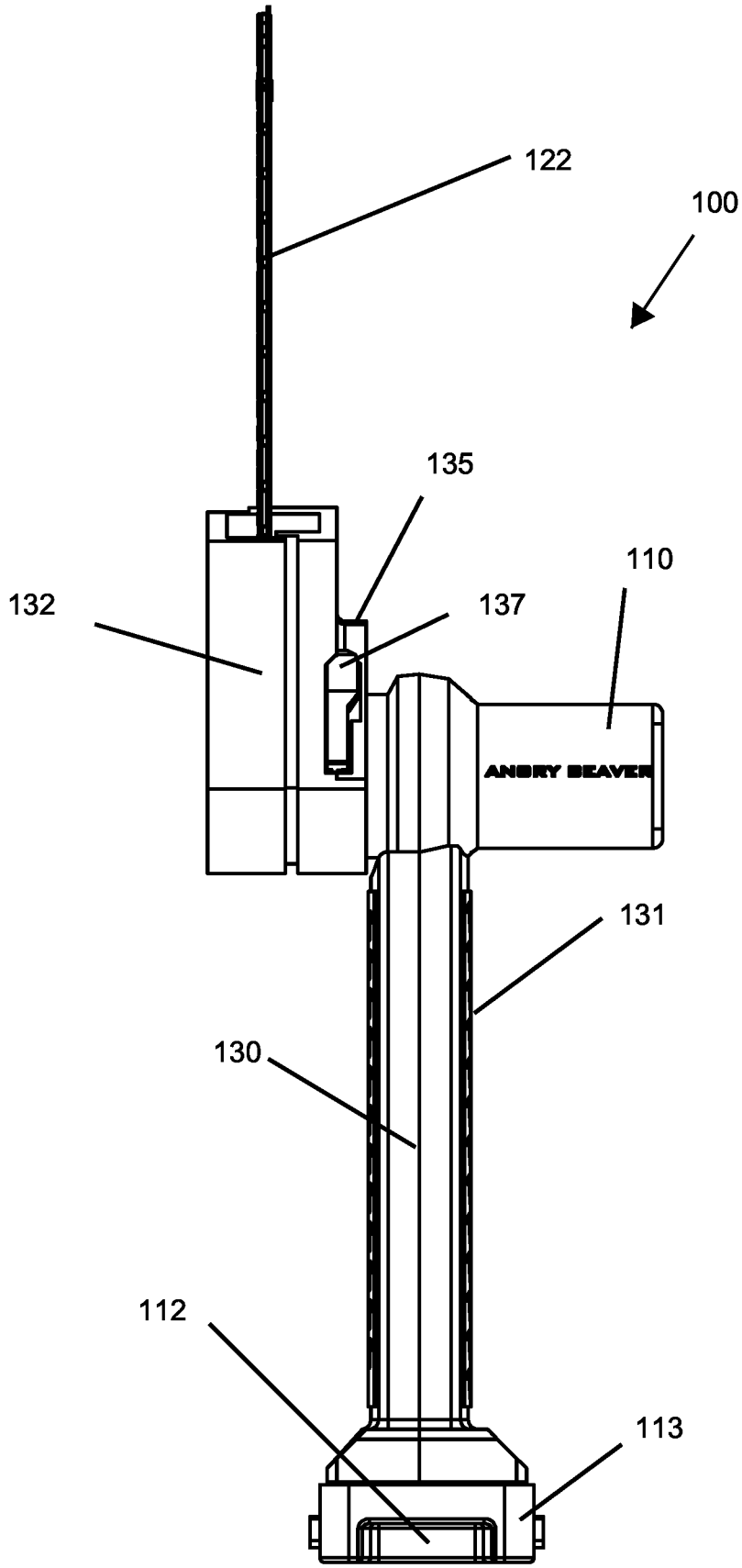
Figure 1C:
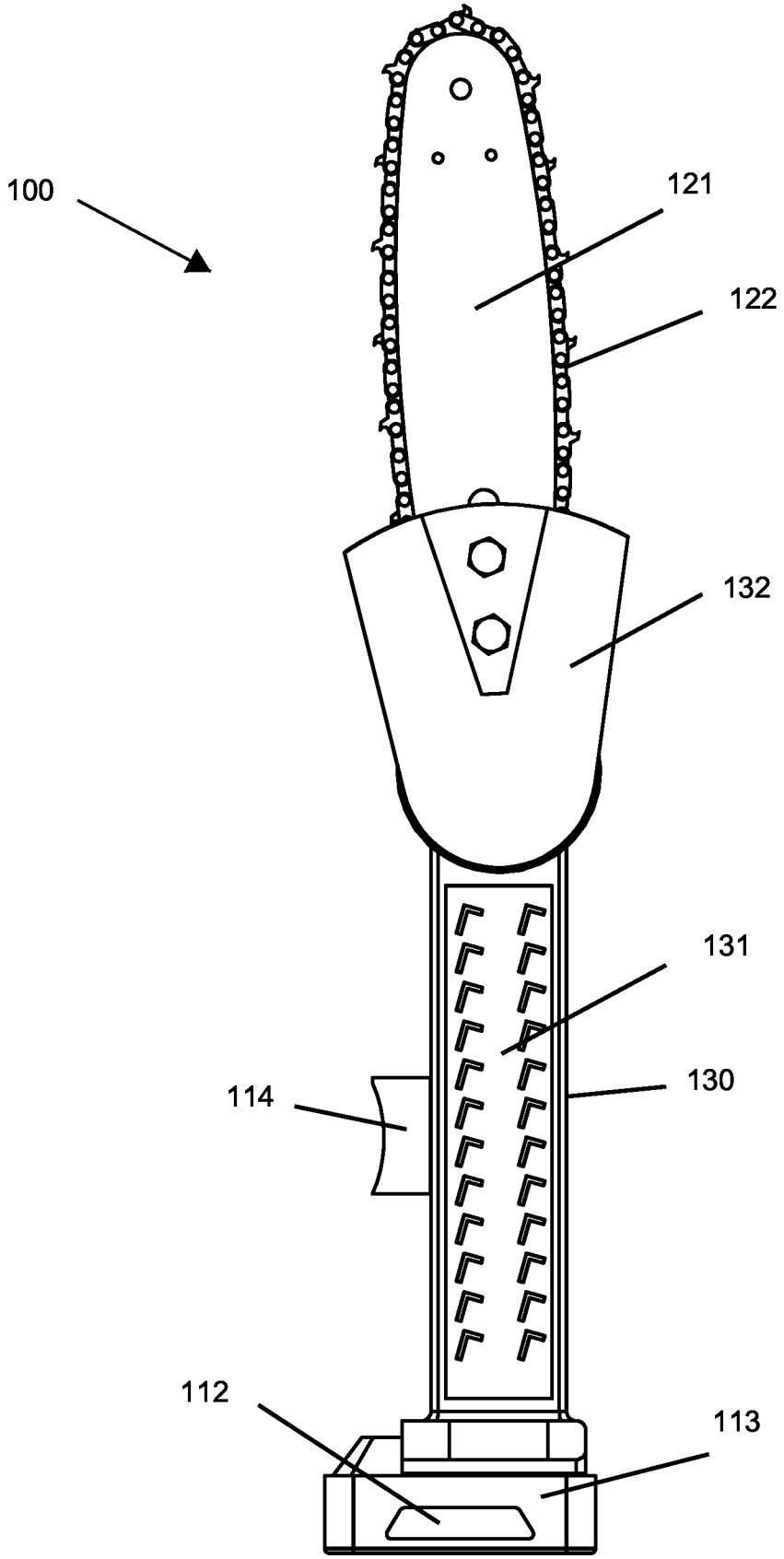
Figure 1D:
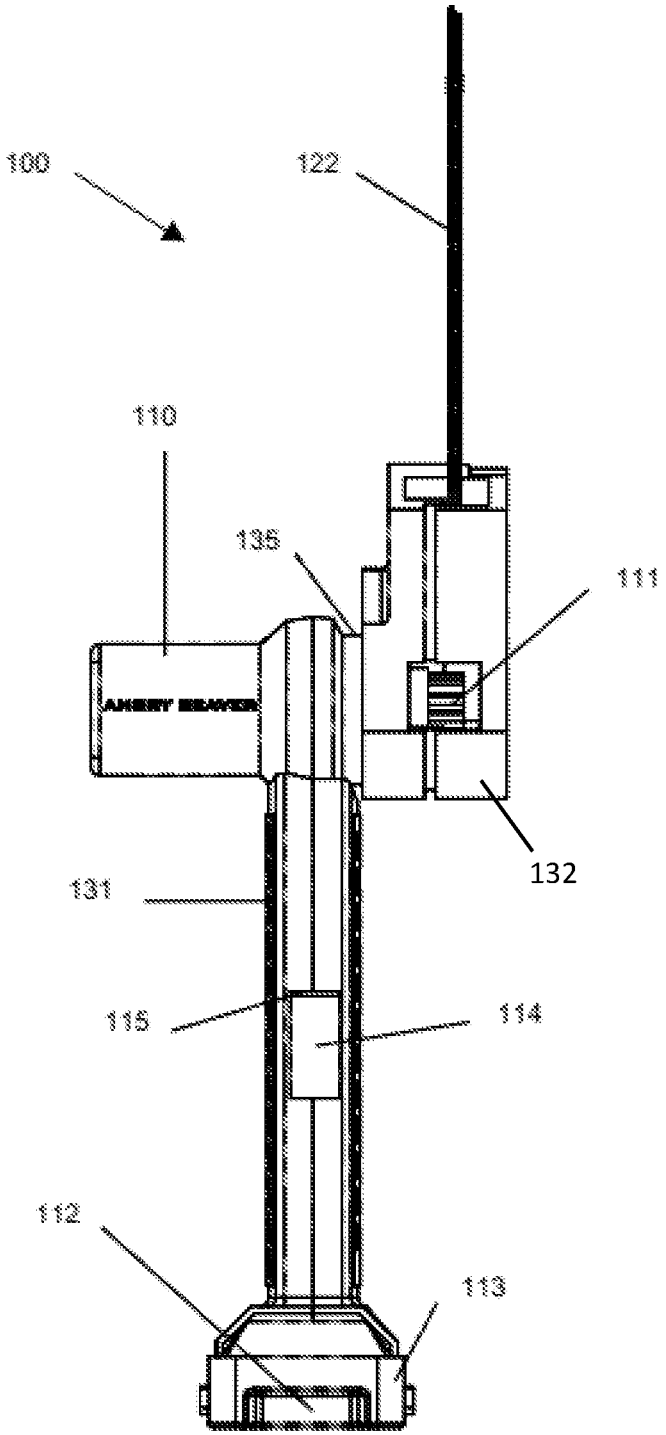

It should be understood that for clarity, not every part is labeled in every drawing. Lack of labeling should not be interpreted as a lack of disclosure.

DETAILED DESCRIPTION

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

The present invention is a collapsible chainsaw 100. The chainsaw 100 includes a protective housing 130 to which a saw bar 121 having a saw chain 122 is rotatably mounted at one end via a positioning hub 133. In the exemplary embodiment pictured, the saw bar 121 is six inches long; other lengths of the saw bar are contemplated. The chainsaw 100 has two configurations. These configurations are the open or cutting configuration, which positions the saw bar 121 straight out from the housing 130 or main body of the chainsaw 100, as seen in FIGS. 1*a*-1*d*. The second configuration is the collapsed or closed configuration, as seen in FIGS. 2*a*-2*d*. For safety, the chainsaw 100 may have only two possible static configurations, open and closed, without any static intermediate configurations.

Figure 2A:
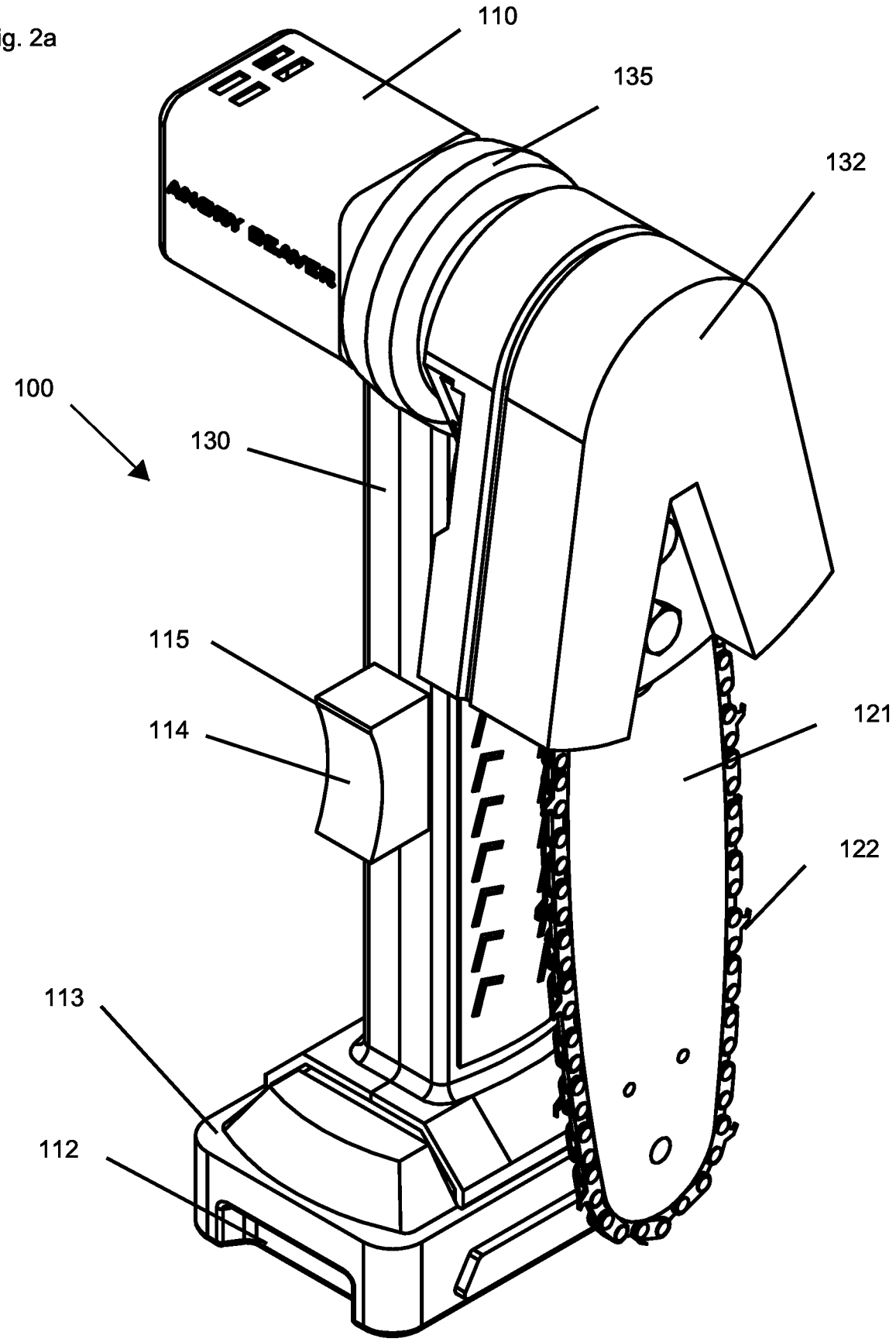
FIGS. 2*a*, 2*b*, 2*c*, and 2*d* illustrate front perspective, top, right side, and front views, respectively, of the exemplary embodiment of the collapsible chainsaw in a collapsed position.
Figure 2B:
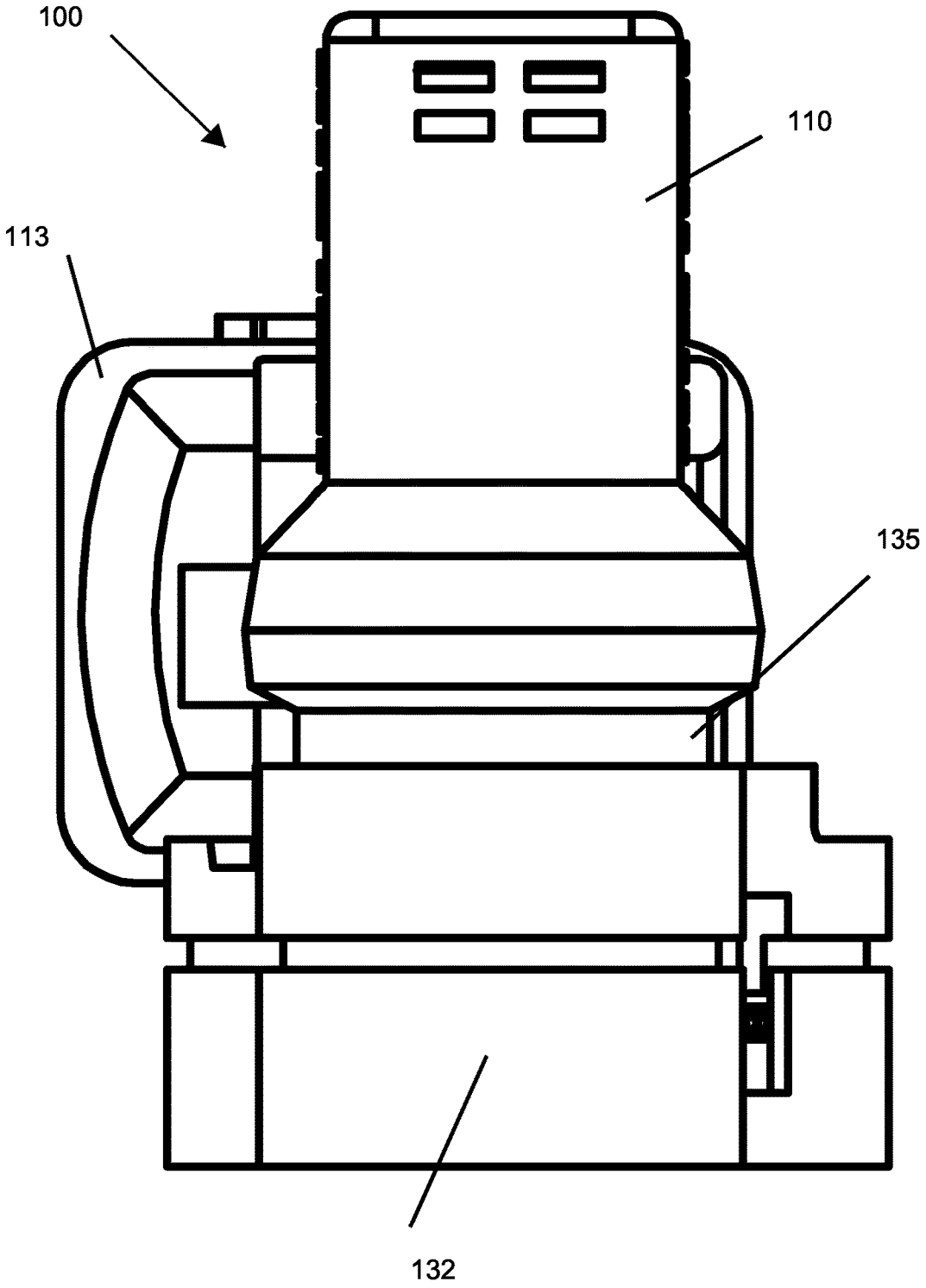
Figure 2C:
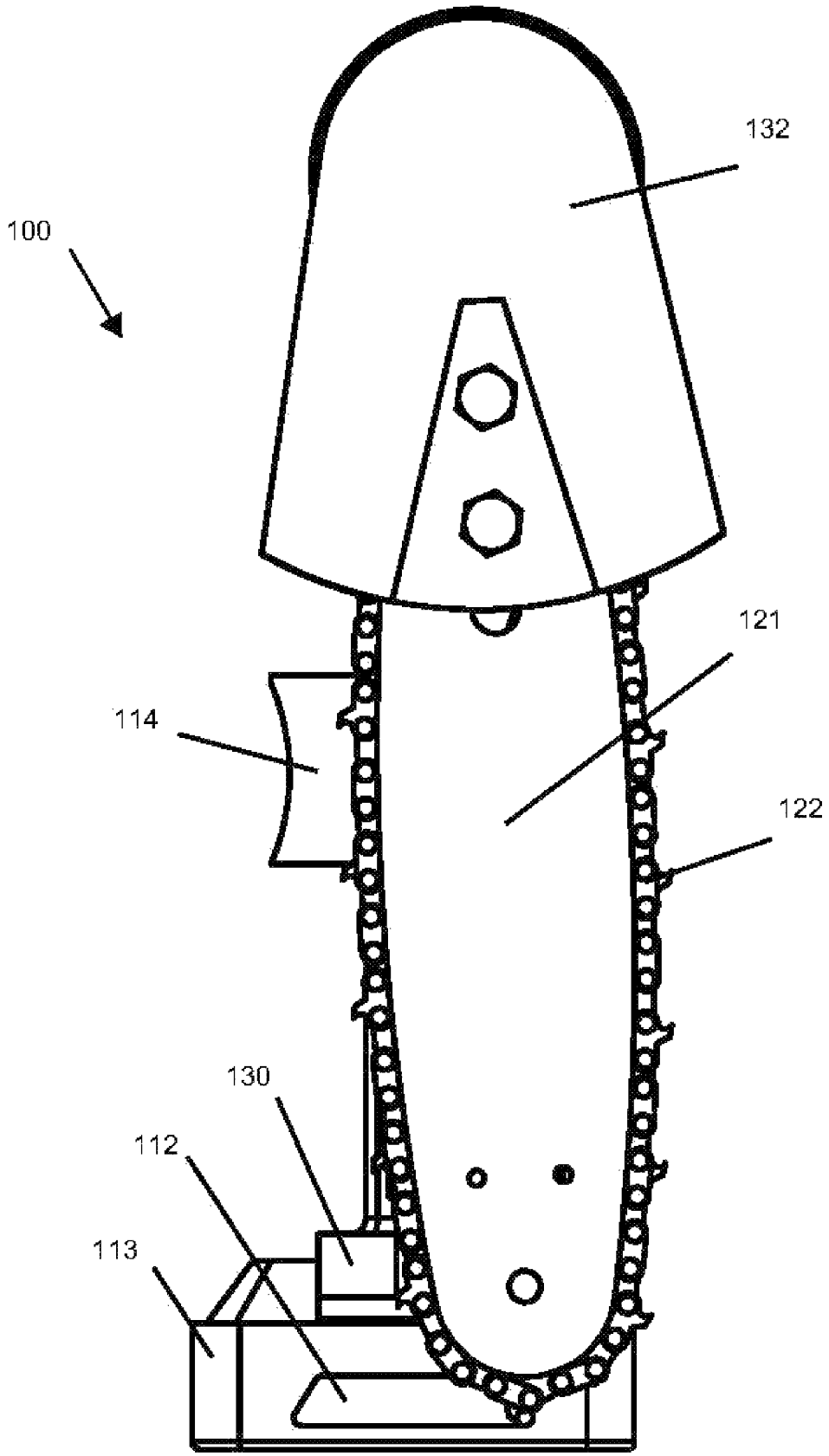
Figure 2D:
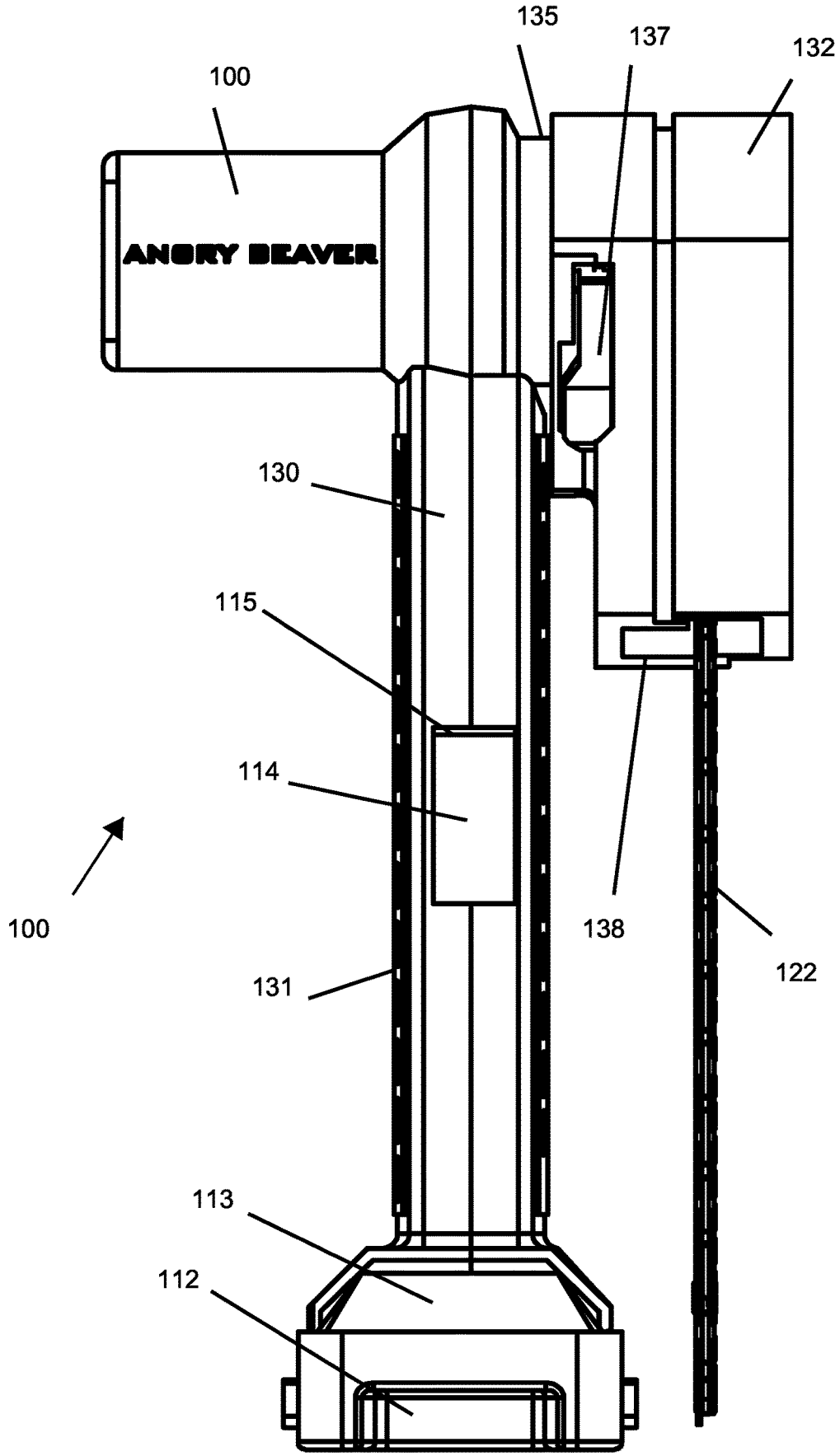

A grip 131 may be placed on the protective housing 130 to receive a user's hand; the grip 131 may be textured, molded, made from a high-friction material, or otherwise constructed to increase the user's grip safety and security. The saw bar 121 may rotate through an approximately 180- to 360-degree arc. The saw bar 121 may rotate about a central axis of positioning hub 133 between a fully deployed position where the saw bar 121 extends distally from a distal end of the protective housing 130 (as seen in FIG. 1*a*) and a fully collapsed position where the saw bar 121 extends proximally from the distal end of the protective housing 130 (as seen in FIG. 2*a*).

The saw chain 122 is driven by a chainsaw drive sprocket 120. A drive shaft 117 passing through the positioning hub 133 couples sprocket 120 to a motor 110. In certain embodiments, the motor 110 is mounted to a side of the protective housing 130 opposite the saw bar 121. In certain embodiments, to prevent accidental activation of the saw chain 122, the motor 110 may only be activated when the saw bar 121 is fully extended. In certain embodiments, to prevent accidental activation of the saw chain 122, chainsaw drive sprocket 120 only engages between the motor 110 and the saw chain 122 when the saw bar 121 is fully extended. In certain embodiments, the motor 110 may be a 12V or 24V motor. In certain embodiments, the motor 110 is a DC motor. In certain embodiments, the motor 110 is a motor that rotates at 6,000 rotations per minute (rpm).

The motor 110 is operably connected to a planetary gear drive system 111 connected to the chainsaw drive sprocket 120 and used to drive the saw chain 122. A battery 112 powers the motor 110. In certain embodiments, the battery 112 is a removable and/or rechargeable battery 112. In certain embodiments, the battery 112 is located at an end of the housing opposite the motor 110. In certain embodiments, the battery 112 is enclosed in a protective battery casing 113. In certain embodiments, the battery 112 is a 12V, 18V, or 24V battery.

A trigger mechanism 114 activates the motor 110. In certain embodiments, the chainsaw 100 includes a safety mechanism 115 to prevent accidental activation of the chainsaw 100. In certain embodiments, the safety mechanism 115 is integral to the trigger mechanism 114. In certain embodiments, the safety mechanism 115 is an electrical or mechanical interlock. In certain embodiments, the safety mechanism 115 includes a circuit interrupter . While in the closed position, the circuit interrupter disables function of the chainsaw 100.

The chainsaw drive sprocket 120 and the proximal end of the saw chain 122 are protected by a cover 132, which rotates through 360 degrees about the central axis of positioning hub 133 with the saw bar 121. The positioning hub 133 is protected by a pivoting collar 135 connected to the cover 132. The cover 132 slips onto the pivoting collar 135 and is secured in place with a nut.

Figure 3A:
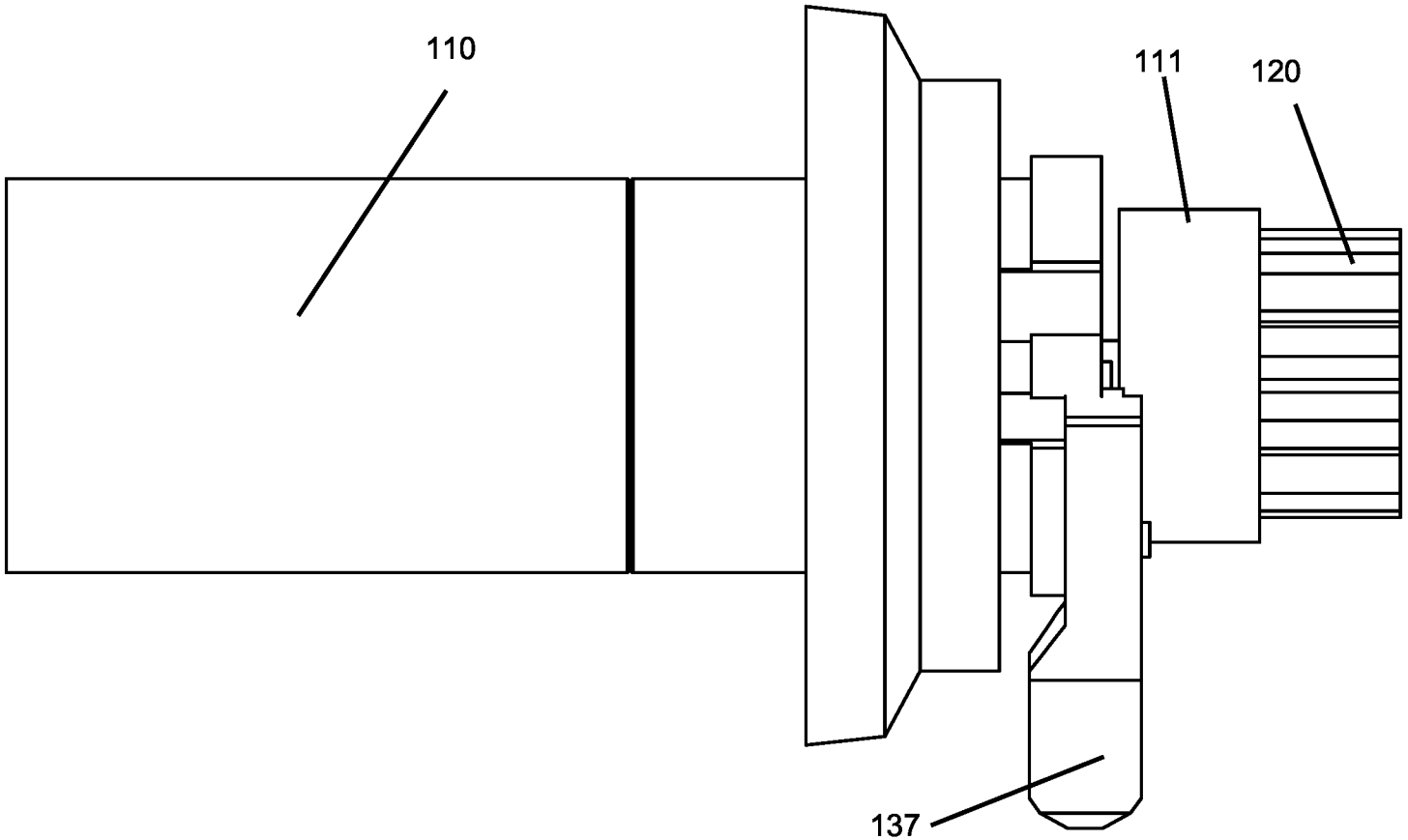
FIGS. 3*a* and 3*b* illustrate front and right side views, respectively, of a positioning hub of the exemplary embodiment of the collapsible chainsaw.
Figure 3B:
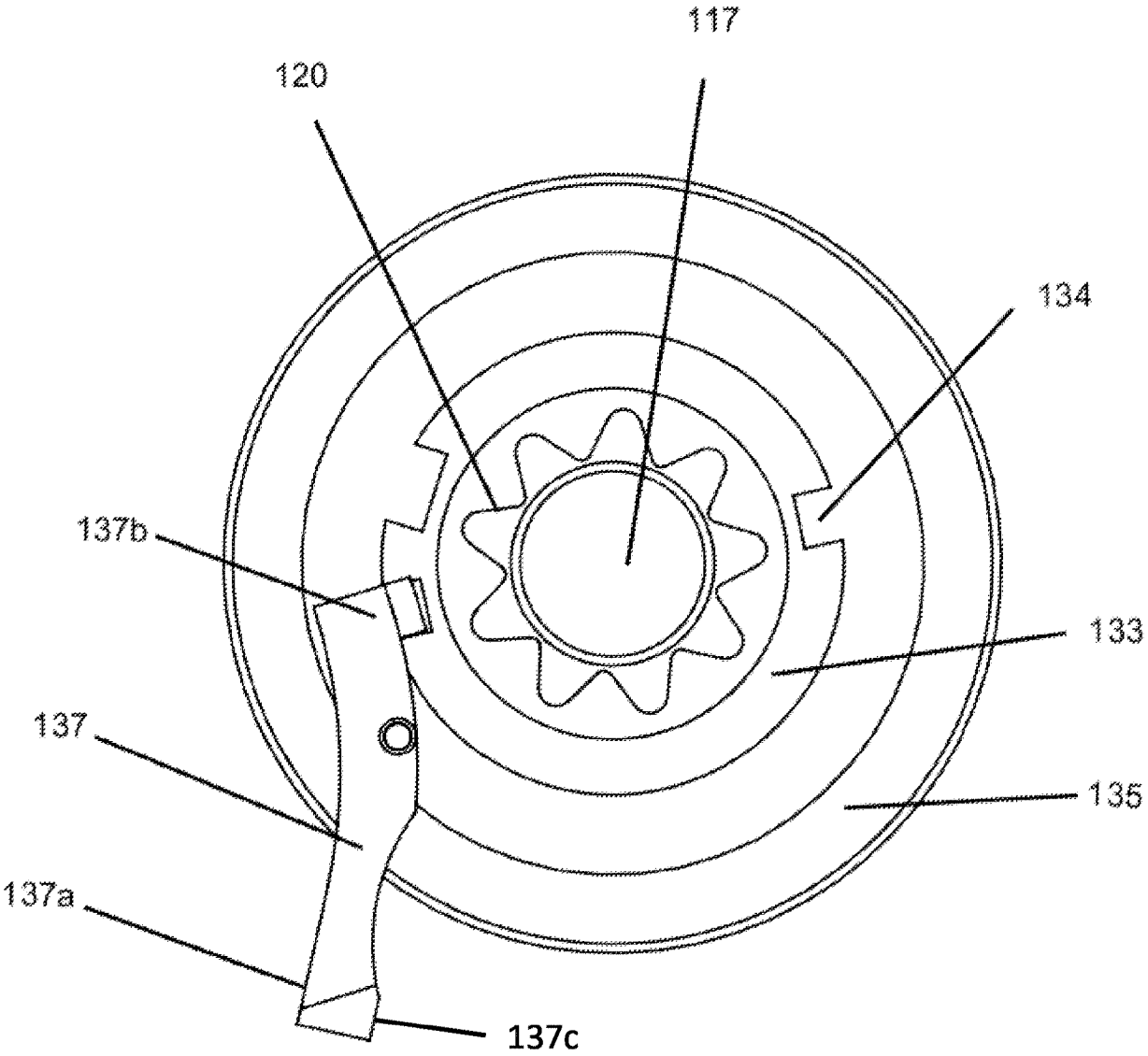

In the present embodiment, the positioning hub 133 is a steel ring with multiple hub notches 134. The present embodiment includes between two and four hub notches 134. To prevent accidental rotation of the saw bar 121, a collapse interlock 137 may be provided with the collar 135 to allow rotation of the saw bar 121 and associated structures. A first end 137*a* of the collapse interlock 137 may be actuated by a user to disengage a second end 137*b* of the collapse interlock 137 from the hub notches 134. In the present embodiment, the collapse interlock 137 is a positioning lever 137*c* as shown in FIG. 3*b*. In certain embodiments, the first end 137*a* of the collapse interlock 137 is a push-button trigger. In certain embodiments, the collapse interlock 137 is spring-biased to engage with the positioning hub 133. In certain embodiments, the collapse interlock 137 may engage with the hub notches 134 in two positions only for either a fully extended or fully collapsed saw bar 121.

In certain embodiments, the saw bar 121 may be a four- to twelve-inch saw bar 121. In certain embodiments, a chain guard 138 may extend at least partially over the saw bar 121 and the saw chain 122 to improve user safety. In certain embodiments, the chain guard 138 is spring-biased so that when not in operation spring pressure on the chain guard 138 holds it down to cover the saw bar 121. While in operation the chain guard 138 rotates upward as the saw chain 122 cuts through material. In certain embodiments, the chain guard 138 is automatically deployed when a triggering action occurs.

In certain embodiments, the protective housing 130 may be a six- to fourteen-inch protective housing 130. In certain embodiments, the protective housing 130 may include an attachment for connecting the chainsaw 100 to a pole and/or a pole saw. Certain embodiments may also include a carrying sheath for carrying and transporting the chainsaw 100. In various embodiments, the carrying sheath may be molded, machined, or press-formed plastic, metal, canvas, leather, composite, or any combination thereof. In certain embodiments, the carrying sheath may include belt-mounting attachments.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and/or method steps described herein may be used alone or in combination with other configurations, systems and/or method steps. It is to be expected that various equivalents, alternatives and/or modifications are possible within the scope of the appended claims.

What is claimed is:

1. A collapsible chainsaw device, comprising:

a motor mounted to a protective housing;

a saw bar mounted to the protective housing by a positioning hub such that the saw bar is rotatable about an axis of the positioning hub from an open configuration where the saw bar extends distally from a distal end of the protective housing to a closed configuration where the saw bar extends proximally from the distal end of the protective housing, wherein the positioning hub comprises a first hub notch corresponding to the closed configuration and a second hub notch corresponding to the open configuration;

a collar surrounding the positioning hub and connected to the protective housing and a collapse interlock extending through the collar to contact the positioning hub, wherein a first end of the collapse interlock is actuatable to disengage a second end of the collapse interlock from the first hub notch or the second hub notch; and a saw chain mounted to a periphery of the saw bar and connected to the motor by a planetary gear drive system which drives a chainsaw drive sprocket, whereby the motor drives the saw chain;

wherein the collapse interlock is a pivoting lever.

2. The device of claim 1, wherein the chainsaw drive sprocket and a proximal end of the saw chain are at least partially covered by a cover connected to the collar.

3. The device of claim 1, wherein the device has the open configuration and the closed configuration, without any static intermediate configurations.

* * * * *